US007638946B2

(12) United States Patent
Kirshner et al.

(10) Patent No.: US 7,638,946 B2
(45) Date of Patent: Dec. 29, 2009

(54) APPARATUS AND METHOD FOR TRAJECTORY MODULATION OF AN ELECTRON BEAM

(75) Inventors: Mark Frederick Kirshner, Redwood City, CA (US); Craig Bisset Wilsen, Redwood City, CA (US); Richard Donald Kowalczyk, San Mateo, CA (US)

(73) Assignee: L-3 Communications Corporation, San Carlos, CA (US)

( * ) Notice: Subject to any disclaimer, the term of this patent is extended or adjusted under 35 U.S.C. 154(b) by 178 days.

(21) Appl. No.: 11/834,568

(22) Filed: Aug. 6, 2007

(65) Prior Publication Data

US 2008/0042073 A1 Feb. 21, 2008

Related U.S. Application Data

(60) Provisional application No. 60/838,580, filed on Aug. 17, 2006.

(51) Int. Cl.
*H01J 23/087* (2006.01)

(52) U.S. Cl. ..... 315/3.5; 315/5.35; 315/5.39

(58) Field of Classification Search ..... 315/3.5, 315/5.16, 5.35, 5.38, 5.39, 15, 404
See application file for complete search history.

(56) References Cited

U.S. PATENT DOCUMENTS 6,417,622 B2 * 7/2002 Theiss ..... 315/3.5
6,617,791 B2 * 9/2003 Symons ..... 315/5.38

FOREIGN PATENT DOCUMENTS

DE 1033342 7/1958
DE 1144853 3/1963
DE 1811640 6/1970

(Continued)

OTHER PUBLICATIONS

"Deflection Microwave Amplifier With Field Emission Arrays" Cha-Mei Tang et al.; Electron Devices Meeting; Dec. 5-8, 1993; pp. 757-760.

(Continued)

*Primary Examiner*—Kiet T Nguyen
(74) *Attorney, Agent, or Firm*—O'Melveny & Myers LLP

(57) ABSTRACT

An electron beam amplification device provides trajectory modulation of an electron beam, and includes an electron gun, a modulator, an interceptor, an output circuit, and a collector. The electron gun produces an electron beam. The modulator receives an RF input signal and provides a corresponding electromagnetic field region that alters trajectory of the electron beam in correspondence with the RF input signal. The interceptor has at least one aperture oriented such that the electron beam transmits through the aperture when the electron beam altered by the modulator follows a particular transmission path and impacts upon the interceptor when the electron beam trajectory altered by the modulator follows a path other than the particular transmission path. The output circuit is arranged so that the electron beam transmitted through the interceptor aperture passes therethrough and produces an RF output signal. The collector recovers remaining energy of the electron beam after passing through the output circuit. An optional post-accelerator may be located between the modulator and the output circuit for increasing energy of the electron beam exiting the interceptor aperture.

22 Claims, 6 Drawing Sheets

FOREIGN PATENT DOCUMENTS

DE 3910822 10/1990

OTHER PUBLICATIONS

"A Discussion of Rotating Wave Fields For Microwave Applications" Jose E. Velazco et al.; IEEE Transactions on Microwave Theory and Techniques; Feb. 1, 1993; pp. 330-335.

"A Chopper Driven 11.4-GHz Traveling-Wave RF Generator" G. Westenskow et al.; Lawrence Livermore National Laboratory; 1991 IEEE; pp. 646-648.

"Choppertron II" T.L. Houck et al.; Lawrence Livermore National Laboratory; 1996 IEEE; pp. 1524-1526.

* cited by examiner

APPARATUS AND METHOD FOR TRAJECTORY MODULATION OF AN ELECTRON BEAM

RELATED APPLICATION DATA

This application claims priority pursuant to 35 U.S.C. § 119(e) to provisional patent application Ser. No. 60/838,580, filed Aug. 17, 2006, the subject matter of which is incorporated by reference herein in its entirety.

BACKGROUND OF THE INVENTION

1. Field of the Invention

The present invention relates to electron beam devices, and more particularly, to an electron tube amplifier utilizing trajectory modulation of an electron beam.

2. Description of Related Art

Electron tube amplifiers are well known in the art for converting the energy of an electron beam to microwave energy in response to an RF drive signal. In a typical linear beam electron device, such as a traveling wave tube (TWT) or klystron, an electron beam originating from an electron gun is caused to propagate through an RF interaction structure. At the end of its travel, the electron beam is deposited in a collector that captures the remaining energy of the spent electron beam. The beam is generally focused by magnetic or electrostatic fields in order for it to be effectively transported from the electron gun to the collector without loss to the interaction structure. In a TWT, for example, an RF wave propagates through a helical structure or set of cavities that comprise the interaction structure, coupling to the electron beam such that the beam gives up energy to the propagating wave. In contrast, the interaction in a klystron is discrete rather than continuous. Thus, the electron device may be used as an amplifier for increasing the power of a microwave signal.

Linear beam electron devices use either velocity or density modulation to establish an AC current in the electron beam that is subsequently converted to RF energy at the output of the device. Velocity modulation works by alternately accelerating and decelerating a beam of electrons passing through an RF driven input structure, such as a cavity or traveling wave circuit. As the electrons drift downstream, their velocity differences cause them to group at the RF frequency. RF current is then induced at the output of the device as the resultant electron bunches pass through. High gain can be achieved by adding circuit components to reinforce the velocity modulation imparted at the input section. When driven to saturation, device efficiency, i.e., the degree to which the DC electron beam power is converted to RF energy, can approach 70 percent. However, in the linear region of operation, a significant portion of the DC beam is not converted to RF, which tends to compromise efficiency. Also, the circuit length required to translate velocity to current modulation is often substantial. This is particularly true in low frequency applications, where velocity modulated amplifiers can be several meters long.

Density modulation works by RF gating the electron flow directly from the cathode surface, accelerating the resulting electron bunches, and extracting power using an output section. As a consequence, density modulated devices are generally considerably shorter than their velocity modulated counterparts. Additionally, because electron emission is controlled by the RF drive level, density modulated devices retain a high degree of efficiency even when operated in the linear region. This characteristic is the reason that inductive output tubes using density modulation have replaced klystrons for UHF television broadcast.

In nearly all density modulated devices, RF gating of the electron emission from the cathode is accomplished via an input cavity structure with a high electric field region situated between the cathode surface and a control grid. The gain of these devices is limited due to the fact that a substantial amount of input power is required to develop an electric field sufficient to draw a moderate amount of electron beam current. The control grid is spaced very close to the cathode, not only to enhance the electric field at the cathode surface, but also to limit the transit angle of the electrons. The transit angle consideration constrains the operation of these devices to the lower frequency end of the microwave spectrum. Devices that use grids for RF modulating the electron beam are also limited in power due to control grid interception.

Therefore, to fully exploit the benefits provided by density modulation, i.e., high efficiency and compact size, without the consequent frequency, power, and gain limitations, it would be desirable to provide a method and apparatus for gating electron current at microwave frequencies that does not rely on a closely spaced control grid.

SUMMARY OF THE INVENTION

The invention provides an apparatus and method for trajectory modulating an electron beam in order to provide the advantages of density modulation without the need for a closely spaced control grid.

In an embodiment of the invention, an electron beam amplification device provides trajectory modulation of an electron beam, and includes an electron gun, a modulator, an interceptor, an output circuit, and a collector. The electron gun produces an electron beam. The modulator has an input cavity arranged so that the electron beam passes therethrough. The input cavity receives an RF input signal and provides a corresponding electromagnetic field region therein that alters trajectory of the electron beam in correspondence with the RF input signal. The interceptor has at least one aperture oriented such that the electron beam is transmitted when the electron beam trajectory is altered by the modulator to follow a particular path and impacts upon the interceptor when the electron beam trajectory is altered by the modulator to follow a path other than the transmission path. The output circuit is arranged so that the electron beam exiting the interceptor aperture passes therethrough. The passing electron beam forms a corresponding electromagnetic field region in the output circuit that produces an RF output signal. The output circuit transmits the RF output signal therefrom. The collector receives the electron beam after passing through the output circuit. The electron beam terminates in the collector and permits recovery of any remaining energy in the electron beam. The electron device may further include an optional post-accelerator located between the modulator and the output circuit for increasing energy of the electron beam exiting the interceptor aperture.

More particularly, the modulator may provide a substantially transverse electromagnetic field region that alters the trajectory of the electron beam laterally with respect to a central beam axis. Alternatively, the modulator may provide a substantially longitudinal electromagnetic field region that imparts velocity modulation of the electron beam. In another alternative, the modulator may provide a substantially transverse electromagnetic field region that alters the trajectory of the electron beam to trace a closed path with respect to a central beam axis, such as a circle or an ellipse. The interceptor may comprise a single aperture offset from a central beam axis, a single aperture aligned with a central beam axis, or a plurality of apertures arranged in a circle.

In another embodiment of the invention, a method is provided for amplifying an RF signal based on trajectory modulation of an electron beam. The method includes: (a) generating an electron beam; (b) modulating the electron beam with an RF input signal to alter trajectory of the electron beam in correspondence with the RF input signal; (c) selectively intercepting the trajectory-modulated electron beam by transmitting the electron beam through an aperture when the electron beam trajectory follows a particular path and collecting the trajectory-modulated electron beam when it follows a path other than the transmission path; (d) producing an RF output signal from the modulated electron beam passing through the aperture; and (e) collecting the energy of the electron beam remaining after producing the RF output signal. The modulating step may further comprise altering the trajectory of the electron beam laterally with respect to a central beam axis, imparting velocity modulation of the electron beam, or altering the trajectory of the electron beam to trace a closed path with respect to a central beam axis.

A more complete understanding of the electron tube amplifier utilizing trajectory modulation of an electron beam will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The invention provides an electron device that uses trajectory modulation of an electron beam in order to achieve high efficiency and compact size, without the consequent frequency, power, and gain limitations of conventional density modulated devices.

Figure 1:
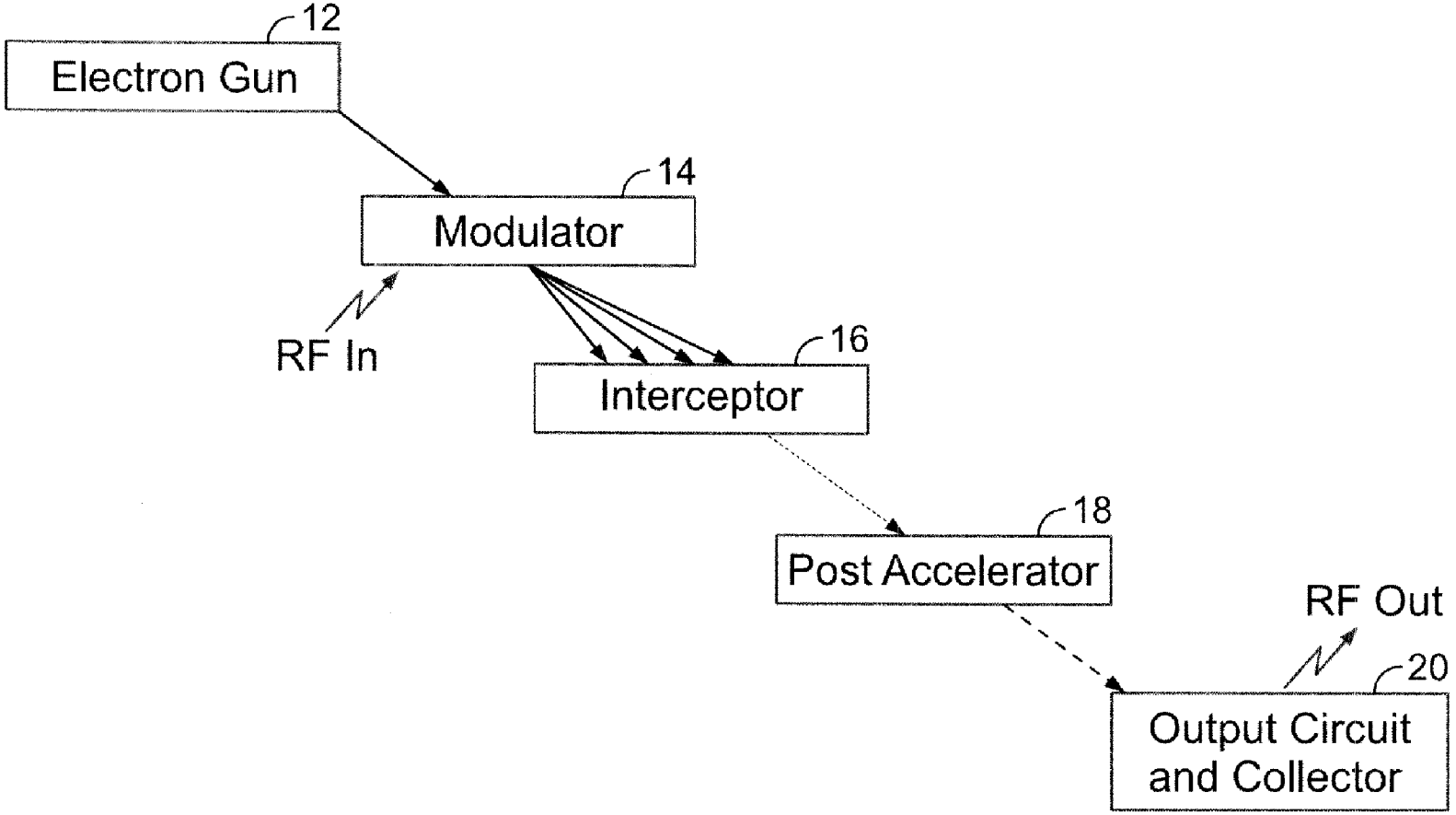
FIG. 1 is a schematic block diagram of an electron device utilizing trajectory modulation in accordance with the invention.

Referring first to FIG. 1, a conceptual diagram of an exemplary amplifier device in accordance with the invention uses trajectory modulation to separate the cathode emission and RF gating functions. Electron current flow is established by an electron gun 12 in a fashion similar to that used in conventional linear beam device electron gun design, e.g., by using a non-intercepting positive anode. In contrast to traditional emission gated devices that are limited by the amount of RF voltage that can be reasonably developed between control grid and anode, very high current levels are readily attained by proper choice of the cathode-anode geometry and the potential difference applied between them. The problem of grid intercept is also eliminated in the present amplifier device, which, in combination with its high current capability, allows electron beam energies significantly greater than those achievable by current emission gated devices. Note that a gridded gun can be used to generate the electron beam without serving as the RF emission gating element.

From the electron gun 12, the electron beam is injected into an RF input system referred to as the modulator 14. The modulator 14 alters the transverse or longitudinal energy of the individual electrons as they pass through. The electron trajectories are changed as a function of the amplitude and phase of the RF drive signal applied to the modulator, either by the deflection imparted by a transverse electric field, or, in a longitudinal case, as a result of space charge induced beam spreading that varies with longitudinal electron velocity.

A collection electrode referred to as the interceptor 16 is located downstream from the modulator 14. The interceptor 16 has one or more apertures that allow only electrons having specific trajectories to pass through. This has the effect of RF gating the electron current since the trajectories are governed by the RF drive applied to the modulator 14. Although a portion of the electron current is collected by the interceptor 16, beam energy loss can be minimized by depressing the interceptor voltage below the initial beam potential. A depressed interceptor 16 can also be beneficial for enhancing electron deflection.

The modulated electron beam emerging from the interceptor 16 can be passed directly through an output circuit 20 for RF power extraction, and collection of the spent beam. Alternatively, it may be desirable to increase the energy of the beam by re-accelerating it. A post-accelerator 18, located between the interceptor 16 and the output circuit 20, is used for this purpose. When equipped with a post-accelerator 18, the present amplifier device is capable of producing very high output power. The post-accelerator 18 also improves device efficiency significantly by minimizing the effect of the current lost to the interceptor 16.

Figure 2:
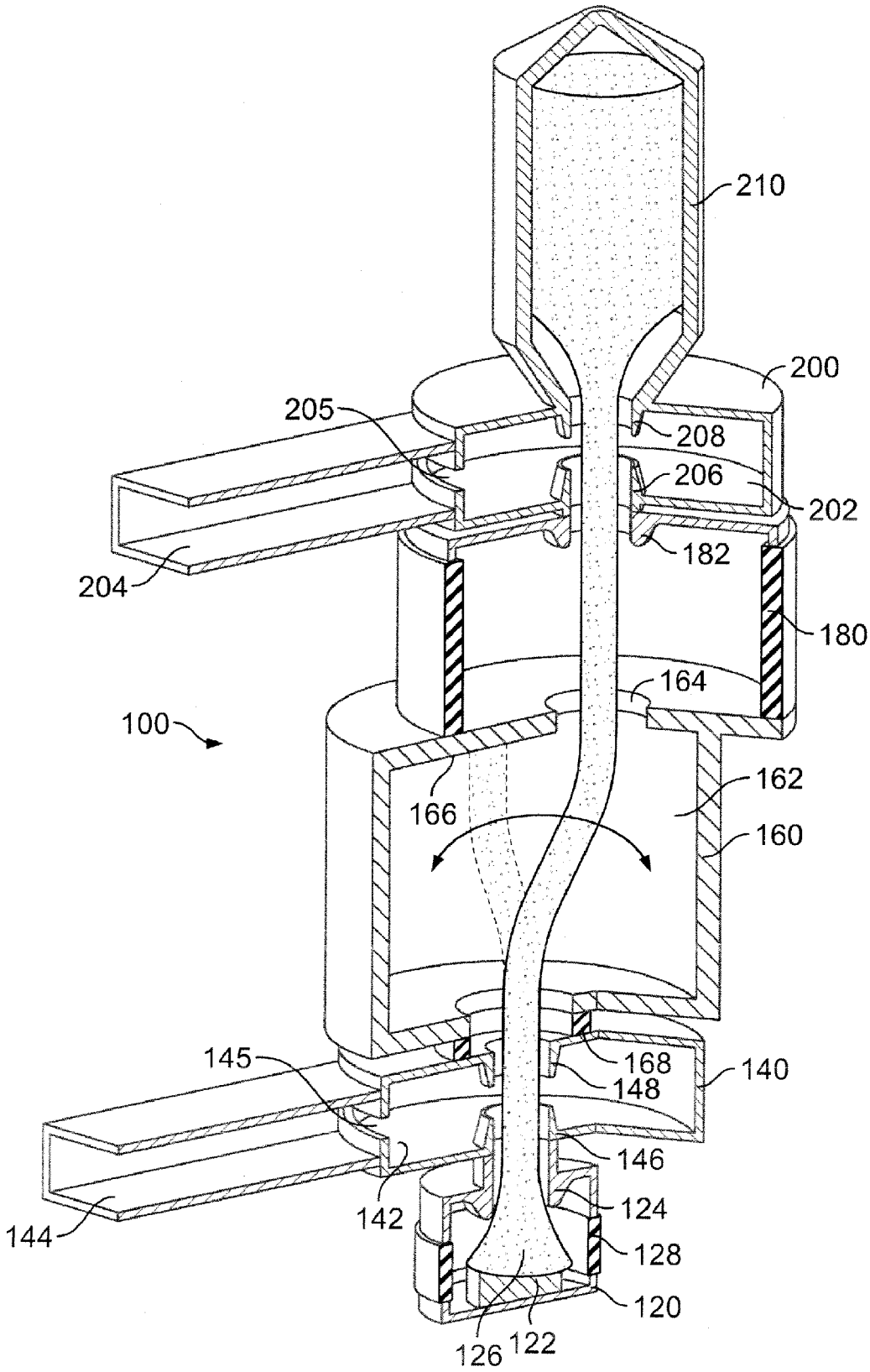
FIG. 2 is a partial sectional view of an exemplary electron device constructed in accordance with a first embodiment of the invention.

An embodiment of an exemplary electron device 100 constructed in accordance with the invention is illustrated in FIG. 2. The electron device 100 includes an electron gun 120, a modulator 140, an interceptor 160, a post-accelerator 180, an output circuit 200, and a collector 210. Beam transport within the electron device can be facilitated by a magnetic or electrostatic focusing system (not shown), as generally known in the art. As further discussed below, an input signal to the electron device 100 is coupled to the electron beam through fields transverse to the direction of beam propagation.

More particularly, the electron gun 120 includes an outer cylindrical shell that substantially contains the electron gun components and facilitates mounting of the electron gun within a larger system. Within the outer shell, a cathode structure 122 has a generally cylindrical shape with a cathode emitting surface arranged perpendicularly to a central axis of the outer shell. An anode ring 124 is aligned with the cathode structure 122 such that an electron beam 126 emitted from the emitting surface passes through the anode ring. An insulating ring 128 divides the outer shell of the electron gun 120 to provide electrical insulation between the cathode structure 122 and the anode ring 124 in order to maintain a high voltage potential sufficient to draw the electron beam 126 from the emitting surface. The electron gun 120 may further include additional focusing electrodes that serve to control the shape of the electric field region between the anode ring 124 and the cathode emitting structure 122, which defines the shape and characteristics of the electron beam 126 that is produced.

After exiting the electron gun 120, the electron beam 126 enters the modulator 140, which produces a deflection of the beam by RF driven transverse fields. The modulator 140 comprises a cavity 142 having ferules 146, 148 defining an ingress and egress path for the electron beam as it passes through the cavity 142. A transverse electromagnetic field is formed within the cavity by an RF signal applied to the modulator 140 through an input port 144. The field produced within the modulator 140 would exhibit the transverse electric (TE) mode in which the electric field vector is normal to the direction of propagation. The RF signal passes through a window 145 defined between the input port 144 and the cavity 142. The window 145 may provide a vacuum seal to maintain a vacuum within the electron device. The modulator 140 alters the transverse energy of the individual electrons of the electron beam 126, causing the electron trajectories to be periodically deflected from side to side in correspondence with the RF signal. The rate in which the beam 126 sweeps back and forth relates to the frequency of the RF signal, and the magnitude of the sweep away from the central axis relates to the amplitude of the RF signal. The transverse movement of the beam 126 is illustrated in FIG. 2 by the arrows.

The electron beam 126 then encounters the interceptor 160. The interceptor 160 comprises a cavity 162 having an aperture 164 defined in a collection plate 166. Electrons deflected in one direction exit the interceptor cavity 162 through the aperture 164. The aperture 164 may be offset with respect to a central axis of the interceptor cavity 162. Electrons deflected in the other direction are collected by the interceptor collection plate 166. As shown in FIG. 2, certain electrons of the beam 126 were deflected to the right by the transverse fields applied in the modulator 140 so that they pass through the aperture 164. When the trajectory of the beam 126 sweeps back in the opposite direction (away from the aperture 164), electrons of the beam are collected on the collection plate 166. The potential within the interceptor cavity 162 may be depressed relative to the initial beam potential to allow energy recovery of the electrons collected on the collection plate 166. The geometry of the interceptor 160 can be optimized to reduce the incident power density in higher power applications. The beam 126 exiting the interceptor aperture 164 is primarily density modulated. The conduction angle, i.e., the portion of the RF cycle that is transmitted through the interceptor 160, is controlled by the magnitude of the drive signal and the aperture geometry. The interceptor 160 can also be configured to pass a DC current component if a less than fully modulated electron beam is desired, e.g., for traveling wave output circuits. An insulating ring 168 may also be disposed between the modulator 140 and the interceptor 160 to maintain electrical isolation between the components.

The modulated electron beam may be further energized by the post-accelerator 180. The post-accelerator 180 includes an electrode 182 similar to the anode ring 124 to increase the energy of the remaining electrons of the modulated electron beam. It should be appreciated that the post-accelerator 180 is an optional structure that would be used only in applications requiring increased electron energy.

Whether or not a post-accelerator is included, the modulated electron beam ultimately passes through an output circuit 200 for RF power extraction. The output circuit 200 comprises a cavity 202 having ferules 206, 208 defining an ingress and egress path for the electron beam as it passes through the cavity 202, and an output port 204 coupled to the cavity 202 through a window 205. An electromagnetic field is formed within the cavity by the modulated beam as it passes through the cavity 200, thereby producing an amplified RF signal that passes through the window and into the output port 204. The amplified RF signal may then be extracted from the electron device through the output port 204. As discussed above, the window 205 may provide a vacuum seal to maintain a vacuum within the electron device.

Lastly, remaining energy of the electron beam is deposited into a collector 210. In the absence of a confining electric field, the spent electron beam becomes unfocused within the collector 210, thereby causing individual electrons to separate from the beam due to their mutually repelling charge, whereupon they impact on the internal walls of the collector. As generally known in the art, the collector 210 may be depressed, i.e., have a voltage applied thereto that is generally smaller than the cathode voltage, and may include plural stages having different respective voltages applied thereto. This tends to improve the collection efficiency of the collector 210.

Figure 3:
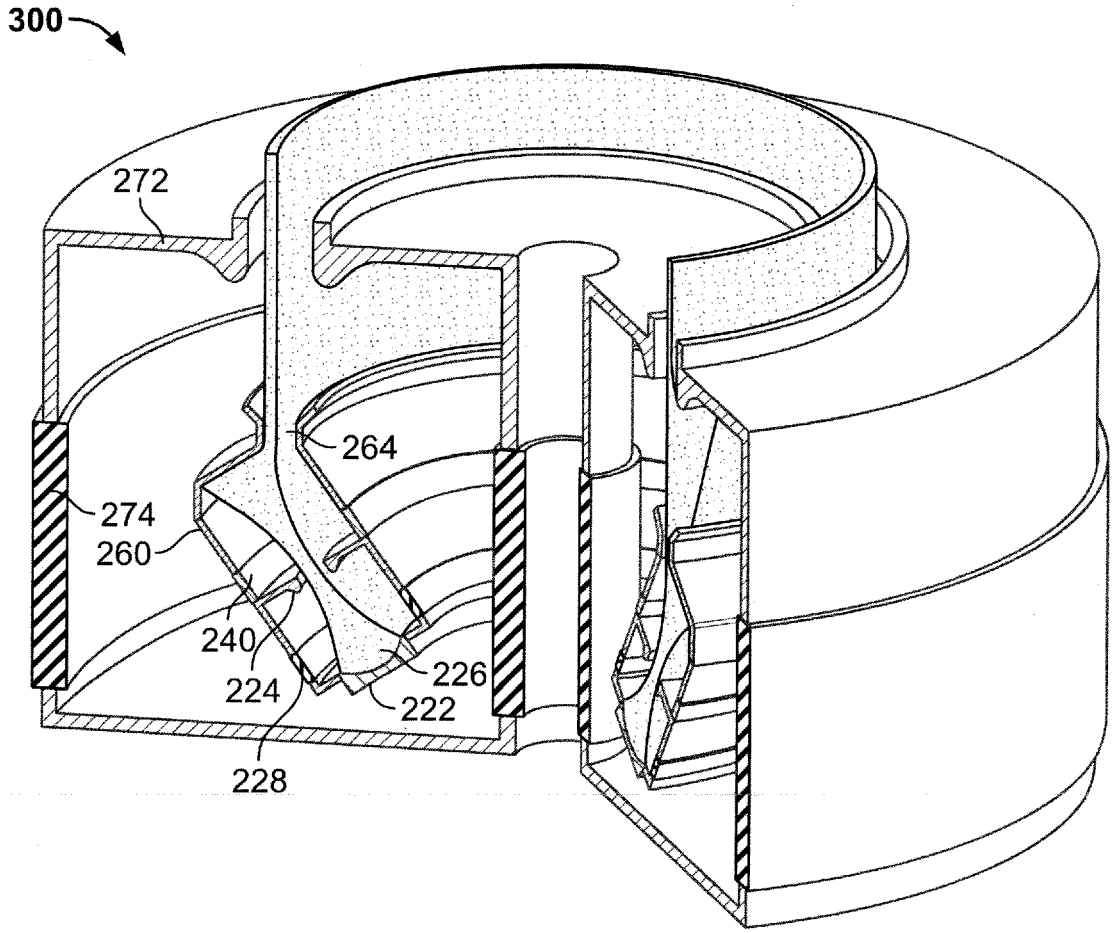
FIG. 3 is a partial sectional view of an integrated input section of the exemplary electron device of FIG. 2 that combines the functions of the electron gun, the modulator and the interceptor.

Another embodiment of an exemplary electron device constructed in accordance with the invention is illustrated in FIG. 3. The electron device of FIG. 3 provides size reduction over the previous embodiment by integrating the input section to include the functions of the electron gun, the modulator and the interceptor.

An integrated structure 300 includes an annular cathode 222 spaced from a corresponding anode 224 to produce a hollow electron beam 226. An insulating section 228 provides electrical insulation between the cathode 222 and the anode 224 in order to maintain a high voltage potential sufficient to draw the electron beam 226 from the cathode emitting surface. As described above, the electron gun may further include additional focusing electrodes that serve to control the shape of the electric field region between the anode 224 and the cathode 222, which defines the shape and characteristics of the electron beam 226 that is produced. The hollow electron beam 226 passes through a modulator 240 that imparts trajectory modulation of the beam by RF driven transverse fields. The beam thereafter passes through an interceptor 260 having an aperture 264. As in the preceding embodiment, when the electron beam sweeps over the aperture 264, a density-modulated electron beam is produced. When the electron beam sweeps away from the aperture 264, the beam is collected on the interceptor 260.

The integrated structure 300 further includes a post-accelerator electrode 272 that also serves as the top of the integrated structure. An insulating ring 274 stands off the accelerating DC bias voltage applied to the post-accelerator electrode 272. It should be appreciated that the toroidally-shaped integrated structure 300 can be utilized in a variety of applications requiring a modulated cylindrical electron beam.

Figure 4:
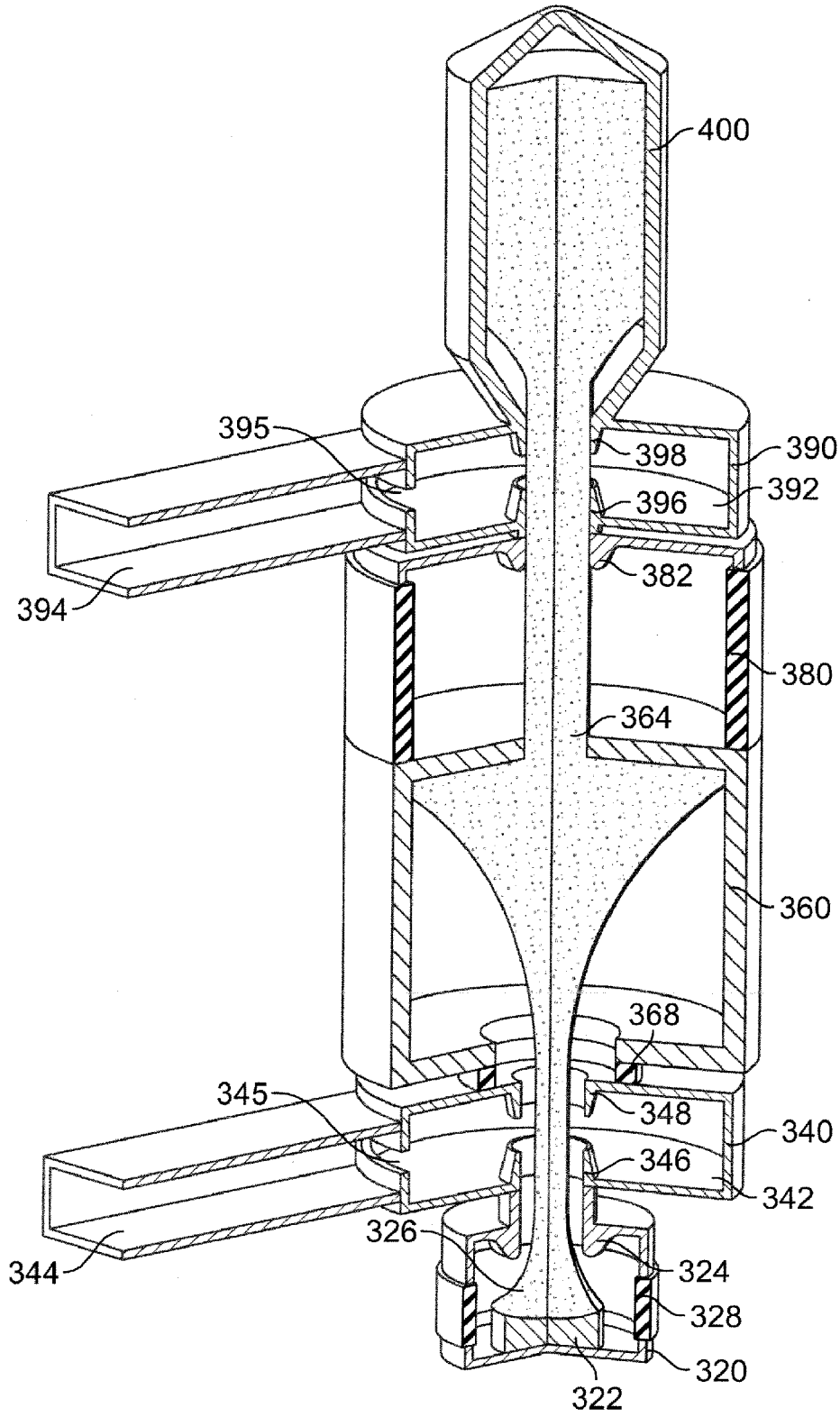
FIG. 4 is a partial sectional view of an exemplary electron device constructed in accordance with a second embodiment of the invention.

A third embodiment of an exemplary electron device constructed in accordance with the invention is illustrated in FIG. 4. As with the embodiment of FIG. 2, this alternative embodiment of the electron device includes an electron gun 320, a modulator 340, an interceptor 360, an optional post-accelerator 380, an output circuit 390, and a collector 400. Beam transport within the electron device can be facilitated by a magnetic or electrostatic focusing system (not shown), as generally known in the art. The electron device can be configured with any of a variety of beam shapes including annular, sheet and cylindrical, and is also compatible with multiple beam arrangements.

The electron gun 320 includes an outer cylindrical shell that substantially contains the electron gun components and facilitates mounting of the electron gun within a larger system. Within the outer shell, a cathode structure 322 has a generally cylindrical shape with a cathode emitting surface arranged perpendicularly to a central axis of the outer shell. An anode ring 324 is aligned with the cathode structure 322 such that an electron beam 326 emitted from the emitting surface passes through the anode ring. An insulating ring 328 divides the outer shell of the electron gun 320 to provide electrical insulation between the cathode structure 322 and the anode ring 324 in order to maintain a high voltage potential sufficient to draw the electron beam 326 from the emitting surface.

After exiting the electron gun 320, the electron beam 326 enters the modulator 340. Unlike the modulator of FIG. 2, the modulator 340 produces longitudinal RF fields that velocity modulate the electron beam 326. The modulator 340 comprises a cavity 342 having ferules 346, 348 defining an ingress and egress path for the electron beam as it passes through the cavity 342. A longitudinal electromagnetic field is formed within the cavity by an RF signal applied to the modulator 340 through an input port 344. The field produced by the modulator 340 exhibits the transverse magnetic (TM) mode in which the magnetic field is perpendicular to the direction of propagation and the electric field is in the direction of propagation. The RF signal passes through a window 345 defined between the input port 344 and the cavity 342. The window 345 may provide a vacuum seal to maintain a vacuum within the electron device. The modulator 340 alters the longitudinal energy of the individual electrons of the electron beam 326, causing certain electrons to accelerate while other electrons are decelerated, thereby resulting in velocity modulation of the beam.

The electron beam 326 then encounters the interceptor 360. The interceptor 360 comprises a cavity 362 having a central aperture 364. The accelerated electrons are sufficiently energetic to exit through the aperture 364, while the decelerated electrons are collected by the interior walls of the interceptor 360. The interceptor potential may be depressed relative to initial beam potential to allow energy recovery. The interceptor geometry can be optimized to reduce the incident power density in higher power applications. The beam 326 exiting the interceptor aperture 364 is primarily density modulated. The conduction angle is controlled by the magnitude of the RF drive signal and the aperture geometry. The interceptor 360 can also be configured to pass a DC current component. An insulating ring 368 may also be disposed between the modulator 340 and the interceptor 360.

The modulated electron beam may be further energized by the post-accelerator 380. The post-accelerator 380 includes an electrode 382 similar to the anode ring 324 to increase the energy of the remaining electrons of the modulated electron beam. It should be appreciated that the post-accelerator 380 is an optional structure that would be used only in applications requiring increased electron energy.

Whether or not a post-accelerator is included, the modulated electron beam ultimately passes through an output circuit 390 for RF power extraction. The output circuit 390 comprises a cavity 392 having ferules 396, 398 defining an ingress and egress path for the electron beam as it passes through the cavity 392, and an output port 394 coupled to the cavity 392 through a window 395. An electromagnetic field is formed within the cavity by the modulated beam as it passes through the cavity 392, thereby producing an amplified RF signal that passes through the window and into the output port 394. The amplified RF signal may then be extracted from the electron device through the output port 394. The density modulated electron beam 326 contains a component of velocity modulation because the modulator 340 causes a spread in electron velocities. As a consequence, appropriate measures may be required to avoid reduction of device efficiency due to de-bunching, as generally known in the art.

Remaining energy of the electron beam is deposited into a collector 400. In the absence of a focusing electric or magnetic field, the spent electron beam becomes unfocused within the collector 400, thereby causing individual electrons to separate from the beam due to their mutually repelling space charge, whereupon they impact on the internal walls of the collector.

Figure 5:
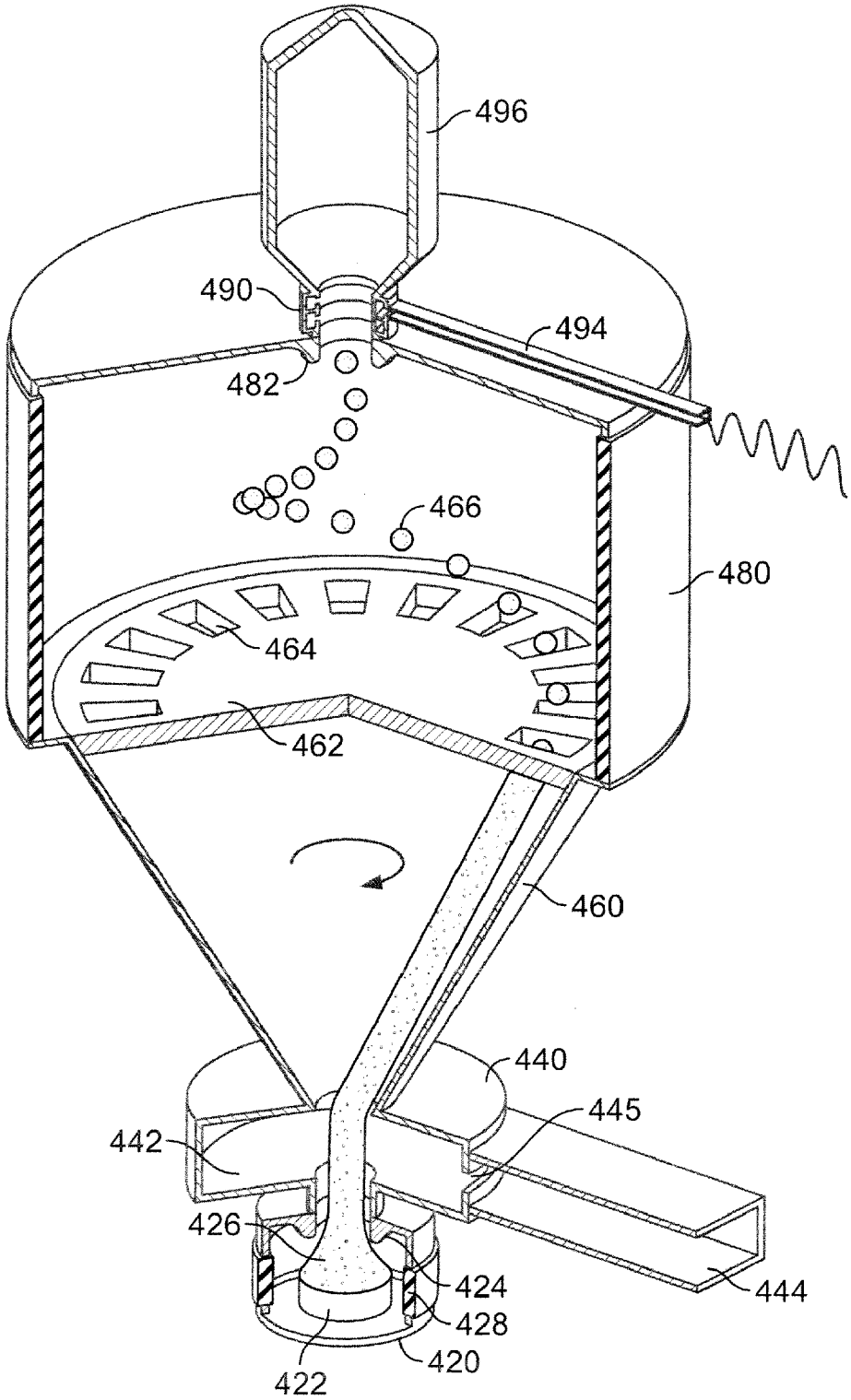
FIG. 5 is a partial sectional view of an exemplary electron device constructed in accordance with a third embodiment of the invention.

A fourth embodiment of an exemplary electron device constructed in accordance with the invention is illustrated in FIG. 5. This embodiment allows frequency multiplication without using harmonic interaction. As with the preceding embodiments, this embodiment includes an electron gun 420, a modulator 440, an interceptor 460, an optional post-accelerator 480, an output circuit 490, and a collector 498. Beam transport within the electron device can be facilitated by a magnetic or electrostatic focusing system (not shown), as generally known in the art. The electron device can be configured with a cylindrical or fan-shaped beam although other shapes can be used.

The electron gun 420 includes an outer cylindrical shell that substantially contains the electron gun components and facilitates mounting of the electron gun within a larger system. Within the outer shell, a cathode structure 422 has a generally cylindrical shape with a cathode emitting surface arranged perpendicularly to a central axis of the outer shell. An anode ring 424 is aligned with the cathode structure 422 such that an electron beam 426 emitted from the emitting surface passes through the anode ring. An insulating ring 428 divides the outer shell of the electron gun 420 to provide electrical insulation between the cathode structure 422 and the anode ring 424 in order to maintain a high voltage potential sufficient to draw the electron beam 426 from the emitting surface.

After exiting the electron gun 420, the electron beam 426 enters the modulator 440. The modulator 440 comprises a cavity 442 having openings defining an ingress and egress path for the electron beam as it passes through the cavity 442. A transverse electromagnetic field is formed within the cavity by an RF signal applied to the modulator 440 through an input port 444. The RF signal passes through a window 445 defined between the input port 444 and the cavity 442. The window 445 may provide a vacuum seal to maintain a vacuum within the electron device. The modulator 440 deflects the electron beam 426 by the transverse electromagnetic field as the beam passes therethrough. The deflection can cause the electron beam 426 to either move back and forth linearly, or to trace out a closed path, such as a circle or an ellipse. The latter can be achieved with orthogonally positioned deflector cavities appropriately phased, or by a single cavity with a rotating mode, typically produced by phased excitation of orthogonal eigenmodes.

The electron beam 426 then encounters the interceptor 460. The interceptor 460 comprises a conical-shaped structure having a slotted plate 462. The slotted plate 462 has round shape with a plurality of symmetrically spaced slots 464 each oriented radially along the peripheral edge of the plate 462. As the electron beam sweeps in a circular motion across the slotted plate 462, the electrons alternate between passing through the slots 464 and being collected. The potential applied to the plate 462 may be depressed relative to initial beam potential to allow energy recovery. The geometry of the interceptor 460 can be optimized to reduce the incident power density in higher power applications.

As shown in FIG. 5, the electrons pass through the successive slots 464, resulting in bunches of electrons (see, e.g., exemplary electron bunch 466). The number of bunches that are transmitted beyond the interceptor 460 during a single cycle of the RF input frequency, $f_o$, is equal to the number of slots, N, traversed on the interceptor. The net beam current is therefore modulated at a frequency $N \times f_o$. Using tapered slots in a circular configuration varies the amount of transmitted current as a function of beam orbit radius, allowing amplitude modulation. Additionally, the slots 464 can be interconnected, providing the beam exiting the interceptor with a DC component. A DC component can also be introduced by using an electron beam cross-section that is greater than the inter-slot spacing.

Figure 6C:
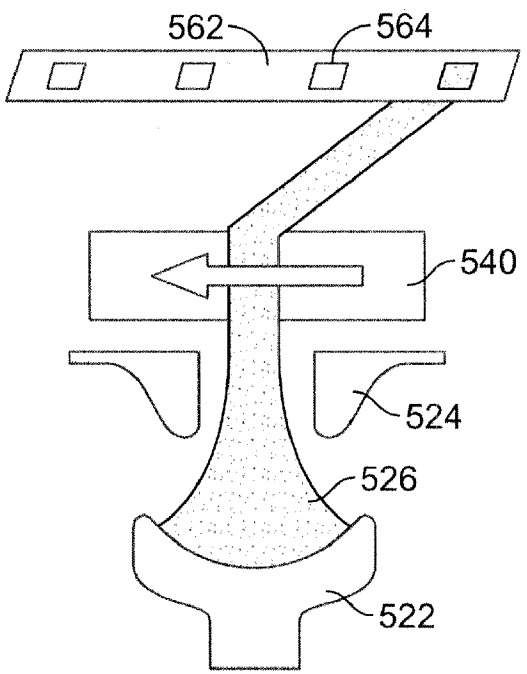
FIGS. 6A-6C are successive schematic representations of the electron device of the third embodiment showing deflection of the electron beam using a transverse electric field.
Figure 6B:
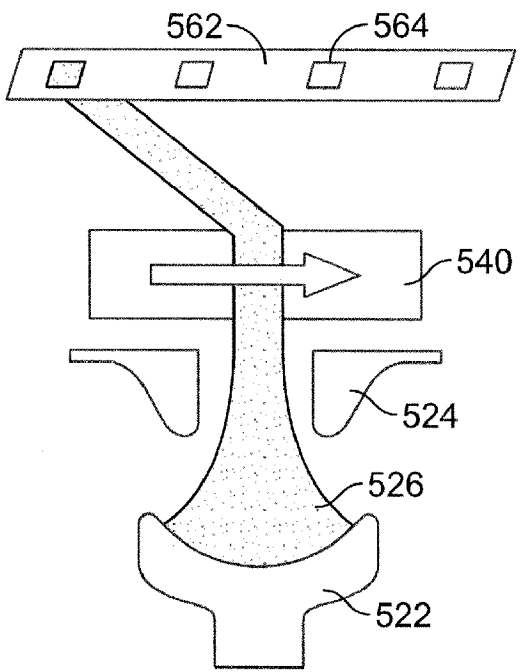
Figure 6A:
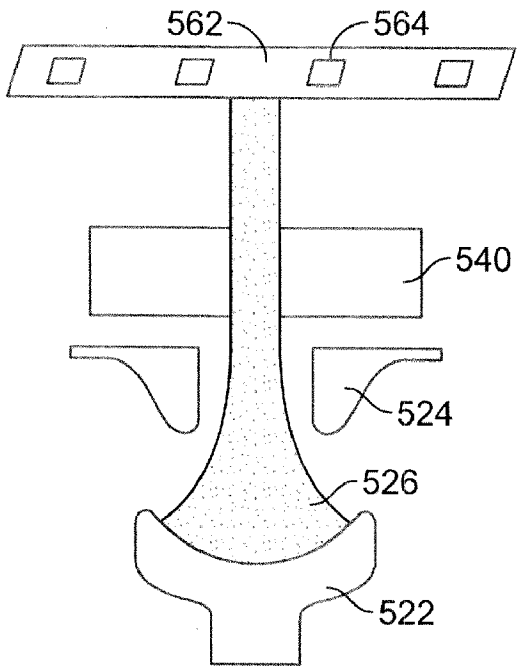

Referring briefly to FIGS. 6A-6C, schematic representations of the amplifier operation is shown. Each figure shows a cathode 522 emitting an electron beam that passes through an anode 524. The beam is then modulated by a modulator 540 and then impacts upon an interceptor plate 562. The interceptor plate 562 includes a plurality of slots 564, such that the beam can be caused to emerge through one of the slots depending upon the modulation applied. In FIG. 6A, the electron beam 526 has no transverse electric field applied by the modulator (i.e., the drive signal is at a null or no drive is applied), causing the beam 526 to be collected on the interceptor plate 562. In FIG. 6B, the modulator 540 applies a transverse electric field pointing in the positive direction, causing the beam 526 to be deflected in the negative direction and pass through a slot in the interceptor plate 562. In FIG. 6C, the modulator 540 applies a transverse electric field pointing in the negative direction, causing the beam 526 to be deflected in the positive direction and pass through a different slot in the interceptor plate 562. Hence, it should be appreciated that the characteristics of the resulting beam can be controlled by operation of the modulator 540.

Returning to FIG. 5, the modulated electron beam may be further energized by the post-accelerator 480. The post-accelerator 480 includes an electrode 482 similar to the anode ring 424 to increase the energy of the remaining electrons of the modulated electron beam. It should be appreciated that the post-accelerator 480 is an optional structure that would be used only in applications requiring increased electron energy. The post-accelerator 480 can additionally be configured to bring the electron bunches back to the central axis, forming a modulated linear beam.

Whether or not a post-accelerator is included, the modulated electron beam ultimately passes through an output circuit 490 for RF power extraction at the higher $N \times f_o$ frequency. As with the preceding output circuits, the output circuit 490 comprises a cavity 492 having defining an ingress and egress path for the electron beam as it passes through the cavity 492, and an output port 494 coupled to the cavity through a window. An electromagnetic field is formed within the cavity by the modulated beam as it passes through the cavity 492, thereby producing an amplified RF signal that passes through the window and into the output port 494. The amplified RF signal may then be extracted from the electron device through the output port 494.

Remaining energy of the electron beam is deposited into a collector 496. In the absence of a focusing electric or magnetic field, the spent electron beam becomes unfocused within the collector 496, thereby causing individual electrons to separate from the beam due to their mutually repelling space charge, whereupon they impact on the internal walls of the collector.

The embodiment of FIG. 5 can be further configured to provide output power at multiple frequencies. As described above, a single interceptor plate 462 with N slots increases the input modulator frequency by a factor of N. Alternatively, if the device were provided with multiple concentric slot rings, with each having a different number of slots, then the output frequency would depends on the ring upon which the beam is tracing across. The output frequency may thereby be controlled by changing the input power. A simple linear arrangement also results in amplitude to frequency conversion, as a larger drive signal causes the beam to be swept over more slots in a single cycle. A fan-shaped beam can be swept across multiple series of slots simultaneously. By appropriately choosing the width and spacing of the slots in each series (i.e., choosing the amplitude and frequency of each component), a particular spectrum can be produced when all the components are added together. For instance, it is possible to produce impulses or other arbitrary waveforms by summing Fourier components. The RF power can be extracted from each individual beamlet using separate output circuits at the input frequency. This effectively integrates a corporate feed output circuit into the device, eliminating the need for a complex and lossy coupler-based distribution network in array driver applications. Manipulation of the phase relationship between the output signals, such as by changing the interceptor slot pattern, may allow the third amplifier to drive a phased array. Although not restricted to such applications, the embodiment of FIG. 5 can be adapted to produce high power at terahertz frequencies.

Various alternative embodiments of the present invention may be made within the spirit and scope of the invention. All input frequencies may be utilized, e.g., the present amplifier can serve low frequency power grid tube applications or generate terahertz radiation. All guns for generating the electron beam in the present amplifier may be utilized, e.g., diode guns, shadow-gridded guns, cold cathodes, photocathodes and magnetron injection guns. Various beam configurations may also be used, including the pencil and hollow-shaped beams described above, as well as sheet beams and multi-beam (i.e., high perveance) configurations. Alternative modulator designs may be utilized. For example, the embodiment of FIG. 5 may be provided with a modulator having an arbitrary number of individual cavities. Alternative interceptor designs for the amplifier may be utilized, e.g., different slot patterns or different interceptor shapes. For example, with dual interceptor apertures, positioned to pass both extremes of trajectory modulation, the embodiment of FIG. 2 becomes either a frequency doubler or a high power, more efficient version of the fundamental frequency amplifier. The latter implementation requires an output circuit that enforces the appropriate phase relationship between consecutive bunches. All output circuits for the present amplifier may be utilized, e.g., extended interaction cavities, ring resonator cavities, higher order mode cavities, helix output circuits, direct collection of the RF beam current, direct integration into an antenna, standing wave output circuits, traveling wave output circuits and fast wave circuits.

Additional circuit elements may also be included to boost the amplifier gain or efficiency. For example, gain cavities in the embodiment of FIG. 4 may be used to reduce the input drive requirement. An inductively tuned penultimate cavity may increase amplifier efficiency by intensifying the electron bunch. Energy recovery from the spent beam of the present amplifier may be utilized, e.g., a multi-stage depressed collector. The use of an electric or magnetic bias, independently or in combination with an RF input signal, to alter the electron beam trajectory may be utilized. For example, in the linear configuration of the embodiment of FIG. 5, a control electrode and tapered slots may provide gain control.

Moreover, the amplifier may be configured as a harmonic frequency multiplier. The cascading and other combination of multiple amplifier elements may be utilized. Oscillator configurations of the amplifier may be utilized. This may be accomplished by feedback of the output signal to the modulator. Also anticipated is a phase-locked oscillator where the beam pre-modulation provides the locking signal. Other implementations of trajectory modulation not embodied in the amplifier may also be utilized.

Having thus described a preferred embodiment of an electron tube amplifier utilizing trajectory modulation of an electron beam, it should be apparent to those skilled in the art that certain advantages of the described apparatus have been achieved. It should also be appreciated that various modifications, adaptations, and alternative embodiments thereof may be made within the scope and spirit of the present invention. The invention is defined solely by the following claims.

What is claimed is:

1. An electron beam amplification device, comprising:

an electron gun producing an electron beam;

a modulator having an input cavity arranged so that the electron beam passes therethrough, the input cavity receiving an RE input signal and providing a corresponding electromagnetic field region therein that alters trajectory of the electron beam in correspondence with the RF input signal;

an interceptor having at least one aperture oriented such that the electron beam is transmitted through the aperture when the electron beam trajectory is altered by the modulator to follow a particular transmission path and impacts upon the interceptor when the electron beam trajectory is altered by the modulator to follow a path other than the transmission path, wherein a voltage applied to the interceptor depresses it below an initial potential of the electron beam to allow recovery of beam energy;

an output circuit arranged so that the electron beam transmitted through the interceptor aperture passes therethrough, the passing electron beam forming a corresponding electromagnetic field region in the output circuit that produces an RE output signal, the output circuit transmitting the RE output signal therefrom; and a collector arranged to receive the electron beam after passing through the output circuit, the electron beam terminating in the collector and permitting recovery of any remaining energy in the electron beam, wherein the collector comprises a multi-stage depressed collector.

2. The electron beam amplification device of claim 1, wherein the electron gun produces a linear electron beam.

3. The electron beam amplification device of claim 1, wherein the electron gun produces a hollow electron beam.

4. The electron beam amplification device of claim 1, wherein the modulator provides a substantially transverse electromagnetic field region that alters the electron beam trajectory laterally with respect to a central beam axis.

5. The electron beam amplification device of claim 1, wherein the modulator provides a substantially longitudinal electromagnetic field region that imparts velocity modulation of the electron beam.

6. The electron beam amplification device of claim 1, wherein the modulator provides a substantially transverse electromagnetic field region that alters the electron beam trajectory to trace a closed path with respect to a central beam axis.

7. The electron beam amplification device of claim 6, wherein the closed path comprises a circle.

8. The electron beam amplification device of claim 6, wherein the closed path comprises an ellipse.

9. The electron beam amplification device of claim 1, wherein the interceptor comprises a single aperture offset from a central beam axis.

10. The electron beam amplification device of claim 1, wherein the interceptor comprises a single aperture aligned with a central beam axis.

11. The electron beam amplification device of claim 1, wherein the interceptor comprises a plurality of apertures.

12. The electron beam amplification device of claim 1, further comprising a post-accelerator located between the modulator and the output circuit, the post-accelerator increasing energy of the electron beam exiting the interceptor aperture.

13. A method for amplifying an RF signal, comprising:

generating an electron beam;

modulating the electron beam with an RF input signal to alter trajectory of the electron beam in correspondence with the RF input signal;

selectively intercepting the electron beam by transmitting the electron beam through an aperture in an interceptor when the electron beam trajectory follows a particular transmission path and collecting the modulated electron beam when the electron beam is altered by the modulator to follow a path other than the particular transmission path;

recovering enemy of the electron beam when it is selectively intercepted by depressing a potential of the interceptor by applying a voltage that is below an initial potential of the electron beam;

producing an RF output signal from the modulated electron beam passing through the aperture; and collecting the energy of the electron beam remaining after producing the RF output signal in a multi-stage depressed collector.

14. The method of claim 13, wherein the generating step further comprises generating a linear electron beam.

15. The method of claim 13, wherein the generating step further comprises generating a hollow electron beam.

16. The method of claim 13, wherein the modulating step further comprises altering the electron beam trajectory laterally with respect to a central beam axis.

17. The method of claim 13, wherein the modulating step further comprises imparting velocity modulation of the electron beam.

18. The method of claim 13, wherein the modulating step further comprises altering the electron beam trajectory to trace a closed path with respect to a central beam axis.

19. The method of claim 13, wherein the intercepting step comprises disposing a single aperture offset from a central beam axis.

20. The method of claim 13, wherein the intercepting step comprises disposing a single aperture aligned with a central beam axis.

21. The method of claim 13, wherein the intercepting step comprises disposing a plurality of apertures arranged in a circle.

22. The method of claim 13, further comprising increasing energy of the electron beam exiting the aperture.

* * * * *